US005120890A

United States Patent [19]

Sachtler et al.

[11] Patent Number: 5,120,890

[45] Date of Patent: Jun. 9, 1992

[54] PROCESS FOR REDUCING BENZENE CONTENT IN GASOLINE

[75] Inventors: J. W. Adriaan Sachtler, Des Plaines; R. Joe Lawson, Palatine, both of Ill.

[73] Assignee: UOP, Des Plaines, Ill.

[21] Appl. No.: 636,354

[22] Filed: Dec. 31, 1990

[51] Int. Cl.[5] ..... C07C 2/66

[52] U.S. Cl. ..... 585/449; 585/323

[58] Field of Search ..... 585/449, 323

[56] References Cited

U.S. PATENT DOCUMENTS

| | | | |
|---|---|---|---|
| 3,246,047 | 10/1962 | Chapman et al. | 260/683.48 |
| 3,293,315 | 12/1966 | Nixon | 260/671 |
| 3,527,823 | 7/1969 | Jones | 260/671 |
| 3,751,504 | 8/1973 | Keown et al. | 260/672 |
| 3,751,506 | 8/1973 | Burress | 260/671 |
| 3,867,473 | 2/1975 | Anderson | 260/683.45 |
| 3,962,364 | 6/1976 | Young | 260/671 |
| 4,016,218 | 4/1977 | Haag et al. | 260/671 |
| 4,107,224 | 8/1978 | Dwyer | 260/671 |
| 4,140,622 | 2/1979 | Herout et al. | 208/93 |
| 4,209,383 | 6/1980 | Herout et al. | 208/93 |
| 4,377,718 | 3/1983 | Sato et al. | 585/467 |
| 4,459,426 | 7/1984 | Inwood et al. | 585/323 |

*Primary Examiner*—Asok Pal

*Attorney, Agent, or Firm*—Thomas K. McBride; John F. Spears, Jr.

[57] ABSTRACT

A process is disclosed for reducing benzene and toluene content in light gasoline streams comprising benzene or benzene and toluene but comprising substantially no other aromatic-hydrocarbons. The light gasoline streams may be prepared by distillation of full boiling range gasoline streams from catalytic reforming or fluidized-bed catalytic cracking units. High alkylating agent to benzene ratios are utilized in the presence of a solid alkylation catalyst to achieve a benzene conversion of 70% of more in a single pass through the reaction zone. Alkylating agent is simultaneously injected into the alkylation zone at two or more separate injection points to minimize undersirable side reactions. The alkylation product may be recovered and blended with other gasoline components to produce automotive fuel which is low in benzene content and high octane in rating.

10 Claims, No Drawings

PROCESS FOR REDUCING BENZENE CONTENT IN GASOLINE

FIELD OF THE INVENTION

The invention is a hydrocarbon conversion process in which volatile aromatics, such as benzene, in a gasoline hydrocarbon stream are alkylated to produce high octane products. The resulting products are depleted in benzene, which is a known carcinogen. The invention therefore relates to the general area of petroleum refining processes used to treat and upgrade gasoline streams. The invention is particularly suited for gasoline precursor hydrocarbon streams which contain a large proportion of benzene, such as catalytically reformed gasolines. The process is directly related to alkylation processes, such as solid phosphoric acid alkylation. The invention is generally related to technology for minimizing and eliminating human exposure to carcinogens.

PRIOR ART

U.S. Pat. Nos. 4,140,622 (Herout et al.) and 4,209,383 (Herout et al.) describe alkylation processes which reduce the benzene content of gasoline streams. Both patents note that high olefin-to-benzene ratios in an alkylation zone promote undesirable side reactions, but neither suggests that the occurrence of undesirable side reactions may be minimized by injecting olefins simultaneously at different points within the reaction zone.

U.S. Pat. Nos. 3,293,315 (Nixon) and 3,527,823 (Jones) disclose processes for producing monoalkylated aromatic hydrocarbons by mixed-phase alkylation at low olefin-to-benzene ratios in the presence of solid phosphoric acid catalysts. Additionally, it is believed that operators of processes similar to those disclosed in the '315 and '823 patents have injected propylene between individual beds of catalyst. These references do not teach high aromatic conversion alkylation.

U.S. Pat. No. 3,751,504 (Keown et al.); contains teaching regarding olefin injection. It describes vapor-phase alkylation of benzene and other aromatics, conducted in the presence of zeolitic-catalyst at high temperature (600°-900° F.) with olefin-to-aromatic ratios of 1.0 or substantially less. This patent suggests addition of an alkylating agent in separate streams to individual reactor stages with cooling between reactor stages.

U.S. Pat. No. 4,377,718 (Sato et al.) discloses that a particular isomer of xylene may be produced by means of a vapor phase methylation of toluene catalyzed by a zeolite if a vapor-phase methylating agent is fed into each of a plurality of series-connected fixed catalyst layers. The '718 patent teaches that the mole ratio of methylating agent to aromatic-substrate in any catalyst layer should not exceed 1.0. Teachings are directed to aromatic conversions of 60% or less.

U.S. Pat. No. 4,459,426 (Inwood et al.) discloses a process for liquid-phase alkylation in the presence of a zeolite catalyst at olefin-to-aromatic molar ratios which are substantially less than one. The '426 patent suggests that olefins may be injected into a reactor at more than one location in order to maintain a reaction temperature by quenching heat of reaction.

U.S. Pat. No. 3,867,473 (Anderson) discloses the use of isoparaffin alkylation with an olefin conducted in liquid phase in the presence of a liquid acid catalyst in two or more successive reaction stages. A separate stream of olefin-acting reagent is charged to each stage. The '473 patent teaches that this method of motor fuel alkylation must be conducted with a molar excess of isoparaffin over olefin-acting agent in each stage.

U.S. Pat. No. 3,246,047 (Chapman et al.) demonstrates that the importance of effective mixing between gaseous olefins and liquid isoparaffins has long been recognized by the practitioners of liquid-phase strong-acid catalyzed motor fuel alkylation. Enhanced mixing is a small part of the instant invention.

U.S. Pat. No. 4,922,053 (Waguespack et. al.) discloses a process for producing ethylbenzene from the alkylation of benzene wherein a portion of the normal overhead polyethylbenzene recycle stream is diverted into at least one section of a multi-bed reactor to increase conversion and lower xylene by-product production.

U.S. Pat. No. 4,950,823 (Harandi et al.) is directed to a process which comprises an integrated product recovery system for a primary catalytic hydrocarbon reforming reactor and a secondary catalytic olefins oligomerization-alkylation reactor. The patent suggests one method of upgrading benzene-rich reformate by means of oligomerization and alkylation.

All of the prior art processes referenced above utilize relatively low alkylating agent to aromatic molar ratios which necessarily result in low aromatic conversion. The present invention is distinguishable in that it employs relatively high alkylating agent to aromatic ratios to produce relatively high aromatic conversions, while maintaining good aromatic alkylation selectivity.

BRIEF SUMMARY OF THE INVENTION

Benzene is a compound that occurs naturally in petroleum but can also be produced synthetically. It has commonly been added to gasoline automotive fuel in order to increase octane rating. However, benzene has recently been recognized as an undesirable and dangerous component in gasoline fuel because of its toxic and carcinogenic effects on humans. Therefore, it would be desirable to alkylate benzene into safer compounds that have octane ratings comparable to or better than that of benzene.

A major obstacle to the eradication of benzene from automotive gasoline on a large scale is that the industrial alkylation of aromatic hydrocarbons has been limited primarily to reaction conditions having an alkylating agent-to-benzene ratio of substantially less than one. Higher alkylating agent-to-benzene ratios have in the past caused excessive oligomerization of alkylating agents, multiple alkylation of aromatic substrates, and coke deposition on solid alkylation catalyst. If higher alkylating agent-to-benzene ratios could be used, they would allow the reduction of benzene levels in gasoline to be accomplished in an economically feasible single-pass process which also produces high octane gasoline. If toluene could be alkylated simultaneously to produce more high octane products and a further increase in liquid volume gasoline yield, cost of eradicating benzene would be further offset. The present invention is a process for reducing the content of volatile aromatics, such as benzene and tolene, in a light gasoline stream by means of a mixed phase, liquid, or supercritical-alkylation reaction conducted in the presence of solid catalyst at alkylating agent-to-benzene ratios greater than two by means of an alkylating agent that is injected simultaneously into the reaction zone at three or more points.

The breakthrough that led to the instant invention was recognition that the desirable products of high ratio alkylation could be economically produced if the alkylating agent were injected at multiple points within the reaction zone. The alkylating agent-to-aromatic ratio must be increased in stepwise fashion to a value between 2.0 and 5. It appears that control over the local concentration of alkylating agents and the presence of a suitable catalyst are the crucial factors in preventing deleterious side-reactions. High alkylating agent-to-benzene ratio processing with multiple injection of alkylating agent allows high aromatic conversion operation and, in the case of solid phosphoric acid catalyst, avoids any need for costly recycling of corrosive, partially reacted streams back to the reactor. The invention minimizes undesirable side reactions which produce high molecular weight oligomers.

In a broad embodiment, the invention is a process for eradicating volatile aromatics from a light gasoline stream, which comprises alkylating with an alkylating agent at least 70 mole percent of said volatile aromatics in one pass through an alkylation zone which is maintained at alkylation conditions and which contains a solid alkylation catalyst bed having an inlet, an outlet, and a multiplicity of injection points spaced uniquely between said inlet and said outlet, the process being further characterized in that the alkylating agent is injected continuously and simultaneously through each of the injection points into the alkylation zone such that the total amount of the alkylating agent injected through all of the injection points is from about 2.0 to about 5.0 times the amount in moles of the volatile aromatics in said light gasoline stream.

In another embodiment, the invention is a process for reducing benzene and toluene content in a light gasoline stream, which comprises: alkylating with an alkylating agent a light gasoline stream comprising one or more volatile aromatics selected from the group consisting of benzene and toluene, but comprising substantially no aromatic hydrocarbons having eight or more carbon atoms per molecule, at an alkylation reaction conversion of at least 70 mole percent based on said volatile aromatics in one pass; characterized in that the alkylating takes place in an alkylation zone which is maintained at alkylation conditions and which contains a solid alkylation catalyst bed having an inlet, an outlet, and one or more injection points uniquely spaced between said inlet and said outlet such that no more than 90 volume percent of the solid alkylation catalyst bed is located between any two adjacent injection points or located between the inlet or the outlet and the injection point which is nearest; the process being further characterized in that the alkylating agent is injected simultaneously into the alkylation zone such that each of the injection points injects no more than 75 mole percent of the total amount in moles of the alkylating agent and such that the total amount of the alkylating agent is from about 2.0 to about 5.0 times the amount of benzene and toluene in moles in said light gasoline stream.

In this embodiment, it is preferred that no less than 5 volume percent of the solid alkylation catalyst bed is located between any two adjacent injection points or located between the inlet or the outlet and the injection point which is nearest.

DETAILED DESCRIPTION OF THE INVENTION

The invention is a process for reducing the content of volatile aromatics, such as benzene and toluene, in a hydrocarbon stream. Benzene is an aromatic hydrocarbon compound consisting of six carbon atoms and six hydrogen atoms arranged in a characteristic ring structure. The Environmental Protection Agency of the United States government and others have identified benzene as a carcinogenic substance which humans can absorb through their skin when contacting liquid benzene and can absorb through their lungs when inhaling benzene vapors. Yet benzene is present in most motor fuels, especially automotive fuels, and is valued as a high octane ingredient. The invention lessens the risk of illness induced by inhalation of benzene vapors because it chemically transforms benzene into other aromatic hydrocarbon compounds which are less toxic and less volatile. These less volatile hydrocarbons are less likely to be inhaled by humans. The compounds produced by this invention have an even higher octane rating than benzene and will be more useful as motor fuel ingredients. Benzene content of a hydrocarbon feed stream will be reduced in the instant invention by alkylating benzene to form alkyl-aromatic compounds. The term volatile aromatics will be used to refer to one or more aromatics selected from the group consisting of benzene and toluene. The invention produces a product stream which is depleted in benzene content and in toluene content and enhanced in alkylbenzene content as compared to a gasoline which serves as feed to the invention.

The hydrocarbon source stream which serves as a source of feed to the invention may be any stream which comprises a substantial proportion of hydrocarbons and benzene. The aromatics in the source stream may comprise toluene and benzene or, alternatively, may consist essentially of benzene. Source streams having substantially no aromatic hydrocarbon molecules containing eight or more carbon atoms are preferred. The invention comprises a solid alkylation catalyst and it is believed that hydrocarbons with eight or more carbon atoms per molecule will coke and foul the solid alkylation catalyst at an unacceptable rate. Streams having such undesirable components may be brought into conformance by removing high molecular weight hydrocarbons through fractional distillation or other separation means. Two preferred sources of feed to the subject invention are catalytic reforming units and fluid catalytic-cracking units.

The process produces a gasoline boiling range product. The term gasoline is intended to refer to a final hydrocarbon product suitable for use as automotive fuel. Gasolines are often produced by blending together several different hydrocarbon streams. Some of these streams do not contain benzene, and therefore do not require treatment by the subject invention. For instance, a benzene-free branched chain paraffinic hydrocarbon stream, such as that produced by the HF-catalyzed alkylation of isobutane, may be used in blending the final gasoline product stream. This blending would preferably be carried out downstream of the subject process in order to avoid unnecessary treatment of benzene-free alkylate material. Likewise, any addition of butane or other light hydrocarbons to adjust the volatility of the product gasoline is preferably accomplished downstream of the subject benzene removal process. An embodiment of the invention comprises admixing a product stream which is depleted in benzene content and enhanced in alkylbenzene content with other automotive fuel components.

A source stream will normally contain about 0.5 to 6.5 or more mole percent benzene. It may also contain various $C_7$ to $C_{10}$ aromatic hydrocarbons. The total concentration of all aromatic hydrocarbons in the source stream may be above 25 mole percent. The source stream will also normally contain some $C_4$ to $C_6$ paraffinic hydrocarbons. These may include butane, isopentane, isohexane and n-pentane, n-hexane and will normally be present at a concentration above 5.0 mole percent. $C_7$ to $C_9$ paraffinic hydrocarbons such as heptanes and iso-octane are also present in many source streams. The concentration of these paraffins will normally be above 2.0 mole percent and may be above 15.0 mole percent. The exact composition of the source stream will depend on its source. Two typical sources of source streams are bottoms product from a stripper column used in FCC gas concentration units and stabilized catalytic reformate which contains $C_6$ to $C_9$ aromatic hydrocarbons.

Light gasoline is a preferred type of source stream for the subject process. As used herein, the term "light gasoline stream" is intended to refer to a benzene-containing stream comprising a mixture of aromatic and paraffin hydrocarbons having boiling points between about 32° C. and 125° C. and which could be used as a major component of gasoline either immediately or after further processing or blending. Light reformate gasoline is especially preferred as a source of feed.

The light gasoline stream which is charged to the subject invention preferably contains substantially no aromatic hydrocarbons other than benzene and toluene, and a high concentration of benzene and toluene is preferred. Therefore, the feed stream which will be adapted for use as light gasoline is often prepared by fractional distillation in a fractionation zone maintained at suitable fractionation conditions. Preferably, this zone comprises a single, trayed fractionation column which is sized according to well known criteria based on the flow rate and composition of the feed stream. The conditions used in this zone may be those which are customary in the art. The criteria for operation of the fractionation zone is that substantially all of the benzene contained in the feed stream is separated into a light gasoline stream, which will be the overhead product of the fractionation zone. Preferably, over 98 mole percent of the benzene is contained in the overhead product stream of the fractionation zone, which is a light gasoline stream. Toluene may also be present in this light gasoline stream, or, optionally, most of the toluene may be retained in the heavy hydrocarbon stream removed as the bottoms product of this fractionation zone. The overhead product of the zone will also contain various $C_4$ to $C_7$ paraffinic hydrocarbons, and possibly some $C_5$ to $C_7$ naphthenes, while substantially all $C_8$ to $C_{10}$ aromatic hydrocarbons will be contained in the heavy hydrocarbon stream.

The invention comprises an alkylation zone wherein alkylation of aromatics by alkylating agents is conducted in the presence of a solid catalyst. Liquid phase or supercritical phase alkylation is superior to mixed-phase alkylation for achieving high benzene conversion. Mixed phase alkylation is superior to vapor phase alkylation. It is believed that alkylating agent tends to concentrate in any bubbles that are present and that such concentration of alkylating agent promotes oligomerization. The deleterious effects of alkylating agent oligomerization are significant in all alkylation processes, but they are most important in processes conducted at high alkylating agent-to-aromatic ratios. Additionally, liquid phase bulk flow tends to wash oligomers and other fouling materials from the solid catalyst surface and so prolongs catalyst operating life.

Whether a particular alkylation zone is operating in mixed-phase is often difficult to determine because alkylation reactions are exothermic and because local composition in an alkylation reactor varies from point to point as reactants are consumed and alkylating agent is injected. Also, the subject invention may be practiced in existing equipment which cannot withstand the internal pressure necessary to achieve completely liquid-phase operation. The benefits of the subject invention will increase as the preferred condition of a single phase is approached throughout the reactor, but the invention is useful when practiced in any mixed phase condition. Therefore, an alkylation zone which contains 10% or more liquid by volume with the balance of reactants and products substantially in the vapor phase will be considered within the scope of the invention. The term "substantially in liquid phase" will be used to describe alkylation zones which are 90% or more liquid phase by volume.

The alkylation zone is operated at conditions which cause at least some of the entering benzene to react with preferred alkylating agents such as light olefins. The benzene is thereby consumed and $C_8$ to $C_{12}$ alkylaromatic hydrocarbons, such as ethylbenzene, diethylbenzene, ethyltoluene, isopropyl benzene, di-isopropyl benzene, or isopropyltoluene, are produced.

High purity streams consisting of one olefin may be employed as the alkylating agent of the invention, but mixtures of olefins will suffice. Preferably, the olefin stream is rich in olefins. The preferred composition of an olefin stream which is utilized as alkylating agent will be influenced by several factors. One of the most important will be the reactions promoted by the catalyst employed in the benzene alkylation zone and the effects of olefin feed stream composition on the reaction zone product distribution. With some catalysts, it may be beneficial to utilize a high purity olefin stream or to minimize the presence of light paraffins such as ethane, propane, and butane. However, it is preferred to utilize a catalyst which will tolerate various amounts of these unreactive light hydrocarbons. This allows the use of lower purity gas streams. Also, streams which are higher in paraffin or inert gas concentrations may be used to improve reactor temperature control by means of absorbing heat of alkylation reaction. One such gas stream is that produced as the overhead product stream of a stripping column employed in a typical FCC gas concentration plant. This gas stream may comprise methane, ethane, ethylene, propane, propylene, butane and various butenes. An olefin-rich $C_3$ to $C_4$ stream derived from the stripping column overhead may also be used.

A preferred catalyst for use in the subject process is a solid phosphoric acid (SPA) catalyst. One reason for this preference is the propensity of SPA catalyst to produce monoalkylated aromatic hydrocarbons from benzene and propylene, relative to most other catalysts. Suitable solid phosphoric acid catalysts are available commercially. As used herein, the term "SPA catalyst" or its equivalent is intended to refer generically to a solid catalyst which contains as one of its principal raw ingredients an acid of phosphorus such as ortho-, pyro- or tetraphosphoric acid. These catalysts are normally formed by mixing the acid with a siliceous solid carrier to form a wet paste. This paste may be calcined and then crushed to yield catalyst particles, or the paste may be extruded or pelleted prior to calcining to produce more uniform catalyst particles. Alternatively, the acid of phosphorous may be impregnated onto a support. In either case, the carrier is preferably a naturally occurring porous silica-containing material such as kieselguhr, kaolin, infusorial earth and diatomaceous earth. A minor amount of various additives such as mineral talc, fullers earth and iron compounds including iron oxide may have been added to the carrier to increase its strength and hardness. The combination of the carrier and the additives normally comprises about 15–40 wt. % of the catalyst, with the remainder being the phosphoric acid. However, the amount of phosphoric acid used in the manufacture of the catalyst may vary from about 8–80 wt. % of the catalyst as described in U.S. Pat. No. 3,402,130. The amount of the additives may be equal to about 3–20 wt. % of the total carrier material. Further details as to the composition and production of typical SPA catalysts may be obtained from U.S. Pat. Nos. 3,050,472; 3,050,473 and 3,132,109 and from other references.

Although SPA catalyst is preferred, the invention may be utilized with any solid alkylation catalyst. Other catalysts of choice include mordenite and omega zeolites. Amorphous silica-alumina, or clay may also be employed. SPA catalyst is favored for its generally superior selectivity in producing monoalkylate. Polyalkylated products tend to elevate the endpoint of finished gasoline above commercially acceptable values and polyalkylation is often accompanied by more rapid carbon deposition on the solid catalyst. Polyalkylation is also objectionable because it unnecessarily consumes olefins. In one embodiment the invention produces a product stream which has an atmospheric boiling endpoint of 230° C. or less as determined by American Society for Testing Materials Method D86.

The alkylation zone is maintained at benzene-alkylation promoting conditions. A general range of these conditions includes a pressure of from about 3 atmospheres to about 80 atmospheres and a temperature of from about 0° C. to about 450° C., with the preferred conditions being dependent on the catalyst system employed. With SPA catalyst, the pressure is preferably from 20 atmospheres to about 70 atmospheres and the temperature is preferably within the range of from about 150° C. to 350° C. The preferred liquid hourly space velocity of the reactants may range from about 0.02 to about 10, based upon light gasoline volume alone and excluding alkylating agent volume. The configuration of the reaction zone may be that which is customarily used with the catalyst system selected for use in the process. With SPA catalysts, upward flow through vertical beds of catalyst is preferred. It is preferred that olefin consumed in the alkylation zone comprises propylene or butene when a SPA catalyst is employed.

In another embodiment the invention is a process for reducing benzene and toluene content in a light gasoline stream comprising one or more volatile aromatics selected from the group consisting of benzene and toluene, and comprising substantially no other aromatic hydrocarbons, which comprises alkylating with an alkylating agent at least 80 mole percent of said volatile aromatics in one pass through an alkylation zone which is maintained at alkylation conditions including a temperature of from about 150° C. to about 350° C., a pressure from about 3 atmospheres to about 80 atmospheres, and a liquid hourly space velocity of from about 0.02 to about 10; the process being characterized in that the alkylation zone contains a solid phosphoric acid catalyst bed having an inlet, an outlet, and one or more injection points uniquely spaced between said inlet and said outlet such that no more than 82 volume percent of the solid alkylation catalyst bed is located between any two adjacent injection points or located between the inlet or the outlet and the injection point which is nearest, and thereby produces a product stream which is depleted in benzene content and toluene content and enhanced in alkylbenzene content as compared to said light gasoline or stream; the process being further characterized in that the alkylating agent is injected simultaneously into the alkylation zone such that each of the injection points injects no more than 75 mole percent of the total amount in moles of the alkylating agent and such that the total amount of the alkylating agent is from about 2.0 to about 3.0 times the amount of benzene and toluene in moles in said light gasoline stream.

Alkylating agents are defined as those molecules that are commonly known in the art to be capable of replacing a hydrogen atom which is bonded to an aromatic carbon atom in a benzene molecule with the result that an alkyl group becomes permanently attached to the aromatic carbon atom. Examples of alkylating agents are olefins, alcohols, ethers, esters, and including alkyl halides, alkyl sulphates, alkyl phosphates and esters of carboxylic acids. The preferred alkylating agents for use in the invention are ethene, propene, butene, methanol, and ethanol. Olefins are especially preferred alkylating agents for use in the subject invention, with ethene, propene, and butene being most preferred. Alkylating agents are often utilized in a mixture which always includes at least one alkylating agent and which sometimes includes other compounds, such as methane, ethane, propane, or butane, as diluents or impurities.

Olefins or other alkylating agents, including those from an external source, may be admixed with the feed stream prior to its initial contact with alkylation catalyst. If any alkylating agents are admixed with the feed stream before it is contacted with catalyst all such admixtures will count together as one injection point. Separate injection points, as the term is used in this application, are by definition separated from each other by a finite distance as measured in the direction bulk process flow through a catalyst bed. Since there is no catalyst in the conduits that lead the feed stream to the catalyst, all admixtures of alkylating agent and feedstream within those conduits must be counted as one injection point. Further alkylating agents of the instant invention are always injected at two or more locations within the alkylation zone in addition to any injection point located upstream of the catalyst. It is also a requirement that the mol ratio of all alkylating agent to benzene and toluene must be 2.0:1.0 or more. This is believed necessary to achieve the alkylation of 90 mole percent of the benzene present in the reaction zone feed stream. However, a very large excess of olefin leads to the production of a relatively large amount of polyalkylated aromatics which boil above the normally accepted gasoline boiling point end points. A very large excess of olefin also leads to undesirable levels of alkylating agent oligomerization. The olefin or other alkylating agent to aromatic hydrocarbon ratio is therefore preferably below 5.0:1.0 and more preferably below 3.0:1.0. These ratios are predicated on an assumption that each mole of alkylating agent is capable of monoalkyating exactly one mole of benzene; if the alkylating agent capable of contributing more alkyl groups the ratios must be adjusted proportionately.

The invention is especially well suited to converting benzene and toluene at high alkylation reaction conversions. Alkylation reaction conversion, when based on benzene, is calculated by dividing the number of moles of benzene leaving the reaction zone in a known time period by the number of moles of benzene entering the reaction zone in the same time period, subtracting this fraction from one, and multiplying the resulting fraction times 100%. Alkylation reaction conversion, when based on toluene, is calculated by dividing the number of moles of toluene leaving the reaction zone in a known time period by the number of moles of toluene entering the reaction zone in the same time period, subtracting this fraction from one, and multiplying the resulting fraction times 100%.

The invention is directed particularly at reducing the concentration of benzene in a gasoline product by means of destroying benzene through chemical reaction. In addition, a secondary benefit accrues because some of the side reaction products are also useful as automotive fuels. Highly branched paraffins are created when molecules of alkylating agent, such as propylene, polymerize with other molecules of alkylating agent. These additional gasolineboiling range products increase the volume of the gasoline product pool and further reduce the concentration of product benzene. Specifically, the dilution effect from polymer gasoline side-reactions typically reduces the benzene content of the $C_5+$ gasoline produced by the invention from 2 to 4 weight percent beyond the reduction due to chemical destruction of benzene. The values reported as "benzene conversion" in Table 1 and elsewhere in this disclosure do not include the beneficial reduction from dilution effects.

The invention is characterized by high alkylating agent-to-aromaticmolar ratios in the alkylation zone and by simultaneous injection of alkylating agent into the alkylation zone at two or more points which are physically separated by distance measured in the direction of flow. Total alkylating agent-to-aromatic molar ratios of less than 1.5 typically convert only about 70% or less of the benzene present in a single pass. The instant invention efficiently achieves an alkylation reaction conversion in one pass of at least 70 mol percent, based on said volatile aromatics such as benzene and toluene. It is preferred that the process alkylates at least 80 mole percent of said volatile aromatics in one pass through the alkylation zone. These desirable alkylation reaction conversions are achieved by choosing an appropriate solid alkylation catalyst and manipulating reaction zone temperature, pressure, space velocity, and alkylating agent composition, total injection rate, and individual injection point rates.

It is expensive to recycle unreacted benzene back to the alkylation zone for further reaction. Simply increasing the alkylating agent-to-aromatic ratio does not reduce high octane gasoline benzene content to acceptably safe levels in a single pass because the additional alkylating agents react with each other to produce oligomers. However, injecting alkylating agent at various points throughout the alkylation zone suppresses the deleterious reactions of alkylating agents with each other and results in substantial destruction of benzene in a light gasoline stream.

The alkylating agent injection points which characterize the invention are dispersed sequentially along the path of bulk process flow within the alkylation zone. They are uniquely spaced between the inlet and the outlet. In this context, the term uniquely spaced means that no two injection points are located at the same distance from either the inlet or the outlet. Thus some injection points are adjacent in the sense that they are nearest neighbors and some are not. If two points used for introducing alkylating agent into the reaction agent are located at the same distance from the inlet or the outlet, they are not separate injection points but merely parallel points. Similarly, all admixtures of feed and alkylating agent prior to contact with the catalyst are counted collectively as one injection point. Parallel points for introducing alkylating agent may be present for purposes such as improving the mixing of alkylating agent with the gasoline precursor hydrocarbon stream. However, the subject invention is directed at alkylating agent injection points which meet the gasoline precursor hydrocarbon steam at different reaction residence times. Only points which are uniquely spaced between the inlet and outlet may be counted as separate injection points for the purpose of the present invention. For example, if a single reaction zone were operating in down-flow, plug-flow fashion, all alkylating agent injection points located at substantially equal elevations would be counted as a single injection point. In the same reaction zone, two injection points or two groups of injection points located at different elevation points would constitute two points which are separated by a finite distance measured in the direction of flow. Similarly, for an ideal radial-flow reactor all points located at an equal radius would constitute one alkylating injection point for the purpose of this invention. It should be apparent that the invention does promote improved mixing and uniform dispersion of reactants but the invention is characterized by the optimization of local concentrations of reactants substantially in the liquid phase throughout the alkylation zone to achieve high conversion of benzene while suppressing deleterious oligomerization and poly-alkylation.

In one embodiment, the alkylating zone has a very large number, a multiplicity, of injection points which are spaced at unique distances from the first catalyst bed inlet and which inject alkylating agent simultaneously. Such a multiplicity of injection points, corresponding to different residence times in a continuous flow reactor, gives the chemical plant operator maximum control over alkylating agent concentration in the reaction zone. However, the investment required to install and maintain a very large number of injection points may not be necessary in every case.

In a simpler embodiment, ten or fewer injection points provide alkylating agent concentration control. In the simpler embodiment, the injection points are spaced between the catalyst bed inlet and outlet such that no more than 90 volume percent of the solid alkylation catalyst bed is located between any two of the injection points or located between an injection point and the inlet or the outlet. The injection points inject alkylating agent simultaneously and each of the injection points injects no more than 75 percent of the total amount of the alkylating agent. The total amount of the alkylating agent injected is from 2 to 5.0 times the amount of in moles benzene and toluene in the feed to the alkylation zone. In another embodiment, the alkylation zone might have 5 or fewer simultaneous operating injection points, each separated by no more than 90 volume percent of the total catalyst volume and each injecting no more than 75 percent of the total.

In yet another embodiment, the invention is a process for reducing the benzene content in gasoline which comprises the steps of: (a.) mixing a light gasoline stream comprising benzene and toluene but comprising substantially no other aromatic hydrocarbons with a first alkylating stream comprising an alkylating agent in a proportion of from about 0.7 to about 1.7 moles of the alkylating agent per mole of benzene in the light gasoline stream in order to produce a first process stream; (b.) passing the first process stream to a first alkylation zone which contains a first bed of solid alkylation catalyst maintained at alkylation conditions and converting the first process stream to a first effluent stream which comprises less benzene and more alkylbenzene as compared to the light reformate stream; (c.) mixing the first effluent stream with a second alkylating stream comprising the alkylating stream in a proportion of from about 0.7 to about 1.7 moles of the alkylating agent per mole of benzene in the light gasoline stream in order to produce a second process stream; (d.) passing the second process stream to a second alkylation zone which contains a second bed of solid alkylation catalyst maintained at alkylation conditions and converting the second process stream to a second effluent stream which comprises less benzene and more alkylbenzene as compared to the first effluent stream; (e.) mixing the second effluent stream with a third alkylating stream comprising the alkylating agent in a proportion of from about 0.7 to about 1.7 moles of the alkylating agent per mole of benzene in the light gasoline stream in order to produce a third process stream; and (f.) passing the third process stream to a third alkylation zone which contains a third bed of solid alkylation catalyst maintained at alkylation conditions and converting the third process stream to a third effluent stream which comprises less benzene and more alkylbenzene as compared to the second effluent stream and which contains an amount of benzene that is less than 30% of the amount of benzene in the light gasoline stream.

The alkylation zone effluent stream will contain residual benzene, the $C_8$ to $C_{12}$ product of the alkylation reaction, oligomerized alkylating agent, and other hydrocarbons such as unreacted $C_4$ to $C_7$ paraffins. The alkylation zone effluent stream is preferably cooled by indirect heat exchange and then passed into a separation zone. This separation zone may take different forms depending on the composition of the alkylation zone effluent stream and the desired composition of the effluent of the process. For instance, $C_2$ and $C_3$ hydrocarbons will normally be removed from the liquid product if it is intended for use in gasoline, while the presence of some $C_4$ hydrocarbons is acceptable in gasoline. Consideration must also be given to the concentration of dissolved light olefins which can be tolerated in the product. The apparatus used in the separation zone may therefore range from a single vapor-liquid separator or knock out vessel to a rectified stabilizer or debutanizer column. A simple vapor-liquid separator could be operated at a pressure slightly less than that used in the reaction zone and a temperature of from about 38° C. to 66° C. A stabilizer would be operated at the customary conditions for this widely practiced separation. The separation zone is preferably operated at conditions effective to remove substantially all hydrogen, methane, ethane, propane, and unreacted alkylating agent from the reaction zone effluent stream. These materials will be concentrated into a light separation zone effluent stream, which may also contain some $C_4$ hydrocarbons depending on the composition of the alkylating agent stream. This stream may contain appreciable amounts of olefins which were not consumed in the reaction zone, and therefore all or a portion of it may be recycled for use in the process. The recycled portion may be passed through a purification zone to remove excessive amounts of unreactive light paraffins. The heavier aromatics, olefins, and paraffins in the reaction zone effluent stream will be concentrated into a heavy separation zone effluent stream. The heavy separation zone effluent stream is then transferred to a final blending system wherein it is adjusted to meet standards, such as octane number and volatility, which have been established for the desired gasoline.

It is within the scope of the subject invention, although it is not preferred, that unreacted benzene or alkylating agents or both be separated from the alkylation zone effluent stream and recycled back to the alkylation zone effluent stream. It appears to the inventors that a high conversion of benzene achieved in one pass will produce the greatest utility in most circumstances. However, the subject invention can and does encompass those circumstances where the cost of separating unreacted benzene or alkyl substitutents is economically justified. It should be apparent that recycling benzene or toluene and alkylating agents will increase net conversion.

The source of the light gasoline stream is not limited to any particular refinery or petrochemical process but it is preferred that the light gasoline stream is a product of catalytic reforming. The light reformate stream produced by distillation of a full boiling range product of catalytic reforming is an especially preferred source of light gasoline for the invention. Catalytic reforming is a wellknown process for refining and upgrading naphtha which comprises a reforming zone which is normally operated at a temperature of from about 290° C. to about 590° C., and preferably from 370° C. to 480° C. As used herein, the term "naphtha" is intended to refer to a mixture of hydrocarbons, including some aromatic hydrocarbons, which has a boiling point range from 32° C. to 260° C., and preferably between 40° C. and 200° C. Catalytic reforming involves vapor phase contacting of feed material with a catalyst containing a platinum group metal in either a fixed bed or a moving bed reactor. The type of reaction zone employed may dictate the ranges of preferred conditions. For instance, a typical hydrogen to hydrocarbon mole ratio is about 10:1 with a fixed bed operation, but may vary from about 0.5: to 20:1. With a moving bed operation, the catalyst is subject to frequent regeneration and lower hydrogen to hydrocarbon ratio of from 1:1 to 5:1 may be employed. The pressure utilized within the reforming reaction zone may vary from about 1.7 atm. to 70 atm. or higher, but is preferably kept within the range of from about 4.5 atm. psig to about 7.0 atm. Generally, the liquid hourly space velocity may be from 0.5 to 10, with from 1.0 to 5.0 being a preferred range.

Catalytic reforming catalysts vary widely in their composition and in their method of manufacture but almost universally contain one or more platinum group metals in an amount of from about 0.01 to 5 wt. % of the composite, with from about 0.10 to 0.80 wt. % being preferred. The preferred metal is platinum, but palladium, rhodium, ruthenium etc. may also be employed. This metal is dispersed on an inorganic oxide support, which is preferably alumina spheres having a diameter of from about 1/16-inch to about ¼-inch. The catalyst will preferably also contain a combined halogen such as chlorine, fluorine or iodine to impart an acid-acting character to the catalyst. This component is suitably present in the range of from 0.5 to about 1.5 wt. % of the composite when measured as the elemental halogen. The catalyst can also contain a promoter component. Typical promoters are rhenium, germanium, tin, and lead. If used, this component is preferably present in an amount of from 0.1 to about 3.0 wt. % of the catalyst when measured as the elemental metal. The subject invention is not centered on the composition of the catalyst used and suitable catalysts are available commercially. Further details of the reforming of hydrocarbons may be obtained by reference to U.S. Pat. Nos. 3,647,680; 3,650,943; and 3,647,686.

The fluidized catalytic cracking unit which produces a gasoline boiling range hydrocarbon stream which may be utilized in the practice of the subject invention comprises two basic zones, a cracking zone and a catalyst regeneration zone. The cracking zone comprises a vertical riser reactor which empties into a large volume enclosed reaction vessel containing a bed of fluidized catalyst. The feed stream to the cracking zone enters the bottom of the riser reactor and contacts finely divided particulate catalyst at a temperature of from about 425° C. to about 565° C. at a pressure of from atmospheric to about 3.4 atm. The catalyst may have a diameter ranging from about 20–150 microns.

The contacting of the feed stream to the fluidized catalyst cracking (FCC) unit with the catalyst under these conditions results in the cracking of a very significant number of the total molecules in the feed stream and the production of hydrocarbons having a great range of boiling points. The reaction product vapors are passed into a separator cyclone which separates most of the entrained catalyst from the vapors. This catalyst is stripped of hydrocarbon vapors and passed into the regeneration zone of the FCC unit. The catalyst is then contacted with an oxygen-containing gas at conditions which support the combustion of a controlled amount of the carbon on the surface of the catalyst. This effects regeneration of catalytic activity of catalyst particles and also produces a large amount of heat, thereby heating the catalyst particles. The resultant hot regenerated catalyst is then passed through a slide valve into the riser reactor of the reaction zone. The reaction zone and the regeneration zone are operated continuously and simultaneously, with streams of catalyst flowing into and from each zone at a relatively uniform rate.

A high temperature vapor stream which is withdrawn from the cracking zone separator cyclone is passed into a lower portion of a refluxed main column of the FCC unit. The entering vapors are cooled and separated by fractional distillation within the main column. The residual catalyst content of the cracking zone effluent stream becomes concentrated in the bottom stream of the main column which is referred to as a slurry oil. Several side-cut streams may be withdrawn from intermediate points of the main column to produce a heavy cycle gas oil, a light cycle gas oil, and one or more naphtha streams. Said naphtha streams are suitable sources of gasoline precursor hydrocarbon streams for the subject invention.

The cracking operation produces a sizable amount of light gases which include $C_1$ to $C_4$ paraffins and $C_2$ to $C_4$ olefins. These light gases and a significant quantity of heavier hydrocarbons are removed from the main column as an overhead vapor stream and passed into an overhead condenser. This produces a liquid phase and a vapor phase which are passed into the overhead receiver of the main column. A portion of the liquid phase may be returned to the column as reflux, with the remaining net liquid and the separated net vapor phase being passed into a gas concentration unit. The net liquid and the separated vapor phase are preferred sources of alkylating agent, taken either directly from the overhead receiver of the main column or after further purification in a gas concentration unit. The FCC main column is normally operated at a superatmospheric pressure below 7.0 atm. and with a temperature of less than 260° C. as measured at the top of the column. Further details on the operation of FCC units and their integration with main columns may be obtained by reference to U.S. Pat. No. 3,849,294 and 4,003,822.

The following example is intended to illustrate specific embodiments of the invention and does not limit the scope of the subject invention in any way.

EXAMPLE 1

Solid phosphoric acid catalyst was ground to 20 to 40 mesh size and loaded into a reactor as three beds in series with each bed containing 25 cubic centimeters of catalyst. The beds were separated by zones filled with alphaalumina particles. A feed stream comprising 0.1% butanes, 8.4 wt. % pentanes, 35.4 wt. % iso-hexanes, 19.8 wt. % normal hexane, 0.7 wt. % $C_6$ napthenes, 9.1 wt. % iso-heptanes, 2.1 wt. % normal heptane, 0.5 wt. % $C_7$ naphthenes, 0.1% iso-octanes, 0.1% olefins, 23.5 wt. % benzene, and 0.2 wt. % toluene was charged to the reactor along with sufficient isopropanol to produce 550 wt. ppm water in the reactor based on the weight of light gasoline charged. Propene and propane in a mole ratio of 83 to 17 which had been acid-washed to remove any nitrogen-based impurities was injected into the feedstream and into the reactor at various points. For convenience, the injection points were labelled A, B, and C, and the solid catalyst beds were numbered in the direction of flow. Injection point A flowed directly into the feed stream before it contacted any catalyst. Injection point B was located between the first and second catalyst beds. Injection point C was located between the second and third catalyst beds. Effluent from the third reactor was analyzed and the results are summarized in Table 1. Each test period was 6.0 hours in duration. In Periods 1, 2, and 3 the total propylene injection for each run was equally divided between Injection Points A, B, and C. In Periods 4 through 13, all of the propylene injected was introduced upstream of the first reactor through Injection Point A. Heaters surrounding the reactor were maintained at 190° C. for the first five periods. In later periods the heater temperature was progressively lowered to vary reaction conversion. Reactor pressure was controlled at 725 psig to produce substantially liquid-phase conditions throughout. The reactor effluent was separated in a debutanizing-type fractionational distillation column into gas and liquid product streams.

TABLE I

| | Triple Injection | | | Single Injection | | | | | | | | | |
|---|---|---|---|---|---|---|---|---|---|---|---|---|---|
| Period | 1 | 2 | 3 | 4 | 5 | 6 | 7 | 8 | 9 | 10 | 11 | 12 | 13 |
| Pressure, psig | 715 | 717 | 726 | 725 | 726 | 724 | 724 | 724 | 724 | 727 | 725 | 724 | 725 |
| LHSV, $hr^{-1}$ | 4.07 | 4.13 | 4.13 | 4.14 | 4.10 | 4.15 | 4.13 | 4.13 | 4.14 | 4.15 | 4.13 | 4.12 | 4.12 |
| Heater Temperature, °C. | 190 | 190 | 190 | 190 | 190 | 175 | 175 | 175 | 175 | 164 | 165 | 155 | 155 |
| Boiling Endpoint of Product, °C. | 218 | 215 | 221 | 212 | 216 | 193 | 207 | 204 | 208 | 206 | 202 | 202 | 176 |
| Feed-RON | 66.4 | 66.4 | 66.4 | 66.4 | 66.4 | 66.4 | 66.4 | 66.4 | 66.4 | 66.4 | 66.4 | 66.4 | 66.4 |
| Product-RON | 84.0 | 83.6 | 82.6 | 82.4 | 82.4 | 82.2 | 82.3 | 82.3 | 82.5 | 83.2 | 83.4 | 83.3 | 83.6 |
| Liquid Feed Cracking, Wt % | 0.3 | .1 | .7 | −.3 | .3 | .4 | .2 | .1 | .5 | .3 | 1.1 | 1.6 | .7 |
| Olefin/Benzene Molar Ratio (total) | 2.4 | 2.4 | 2.3 | 2.2 | 2.2 | 2.3 | 2.3 | 2.3 | 2.3 | 2.4 | 2.4 | 2.3 | 2.3 |
| Olefin/Aromatic Molar Ratio (total) | 2.4 | 2.4 | 2.3 | 2.2 | 2.2 | 2.3 | 2.3 | 2.3 | 2.3 | 2.4 | 2.4 | 2.3 | 2.3 |
| Propylene Conversion, % mol | 94.1 | 94.5 | 94.6 | 98.5 | 98.7 | 96.9 | 96.4 | 95.4 | 95.1 | 93.4 | 92.3 | 87.4 | 88.0 |
| Olefin Selectivity: New Aromatic, C % | 0.8 | 0.8 | 1.8 | 1.9 | 3.1 | 1.7 | 2.1 | 1.6 | −1.1 | 0.4 | .6 | −2.2 | −0.9 |
| Olefin Selectivity: Alkylation, C % | 50.8 | 48.8 | 52.4 | 45.6 | 46.8 | 42.6 | 43.0 | 42.2 | 41.2 | 38.8 | 40.3 | 39.3 | 40.1 |
| Selectivity: Oligomerization, C % | 48.4 | 50.5 | 45.8 | 52.5 | 50.1 | 55.8 | 54.9 | 56.2 | 59.9 | 60.8 | 59.1 | 63.0 | 60.8 |
| Benzene Conversion, % mol | 89.4 | 88.9 | 90.0 | 79.3 | 79.1 | 76.5 | 76.8 | 75.5 | 75.8 | 73.8 | 74.1 | 70.6 | 70.2 |

The method demonstrated in Periods 4 through 13 is not within the scope of the subject invention because it utilized only one injection point. Those periods produced relatively low benzene conversion and relatively low propylene selectivity to alkylation, as compared to Periods 1, 2, and 3. It is particularly informative to compare the results of periods 1 through 3 with those of periods of 6 through 9. These periods share a narrow range of propylene conversions, but the periods with multiple point alkylating agent injection show much better selectivity for alkylating aromatics. Furthermore, a significant difference was detected even though the total propylene-to-benzene molar ratio was essentially identical for all of the test periods.

Periods 1, 2, and 3 demonstrate the surprising performance of the subject invention. High benzene conversions of over 89 mol % were achieved in a single pass. Propylene selectivity to aromatics was significantly greater than that of the prior art.

What is claimed is:

1. A process for eradicating volatile aromatics from a light gasoline stream, which comprises alkylating with an alkylating agent at least 70 mole percent of said volatile aromatics in one pass through an alkylation zone which is maintained at alkylation conditions and which contains liquid phase reactants and a solid alkylation catalyst bed having an inlet, an outlet, and a multiplicity of injection points uniquely spaced between said inlet and said outlet, the process being further characterized in that the alkylating agent is injected continuously and simultaneously through each of the injection points into the alkylation zone such that the total amount of the alkylating agent injected through all of the injection points is from about 2.0 to about 5.0 times the amount in moles of the volatile aromatics in said light gasoline stream.

2. The process of claim 1 further characterized in that the process comprises alkylating at least 80 mole percent of said volatile aromatics in one pass through the alkylation zone.

3. The process of claim 2 further characterized in that the volatile aromatics consist essentially of benzene.

4. The process of claim 1 further characterized in that the alkylating agent is selected from the group ethene, propene, butene, methanol, and ethanol.

5. The process of claim 1 further characterized in that the alkylation conditions include a temperature of from about 0° C. to about 450° C., a pressure of from about 3 atmospheres to about 80 atmospheres, and a liquid hourly space velocity of about 0.02 to about 10.

6. The process of claim 1 further characterized in that the solid alkylation catalyst is solid phosphoric acid catalyst.

7. A process for reducing benzene and toluene content in a light gasoline stream which comprises: alkylating with an alkylating agent a light gasoline stream comprising one or more volatile aromatics selected from the group consisting of benzene and toluene, but comprising substantially no aromatic hydrocarbons having eight or more carbon atoms per molecule, at an alkylation reaction conversion of at least 70 mole percent based on said volatile aromatics in one pass; characterized in that the alkylating takes place in an alkylation zone which is maintained at alkylation conditions and which contains liquid phase reactants and a solid alkylation catalyst bed having an inlet, an outlet, and one or more injection points uniquely spaced between said inlet and said outlet such that no more than 90 volume percent of the solid alkylation catalyst bed is located between any two adjacent injection points or located between the inlet or the outlet and the injection point which is nearest; the process being further characterized in that the alkylating agent is injected simultaneously into the alkylation zone at multiple injection points such that each of the injection points injects no more than 75 mol percent of the total amount in moles of the alkylating agent and such that the total amount of the alkylating agent is from about 2.0 to about 5.0 times the amount of benzene and toluene in moles in said light gasoline stream.

8. A process for reducing benzene and toluene content in a light gasoline stream comprising one or more volatile aromatics selected from the group consisting of benzene and toluene, and comprising substantially no other aromatic hydrocarbons, which comprises alkylating with an alkylating agent at least 80 mole percent of said volatile aromatics in one pass through an alkylation zone which is maintained at mixed-phase alkylation conditions including a temperature of from about 150° C. to about 350° C., a pressure from about 3 atmospheres to about 80 atmospheres, and a liquid hourly space velocity of from about 0.02 to about 10; the process being characterized in that the alkylation zone contains a solid phosphoric acid catalyst and has an inlet, an outlet, and one or more injection points uniquely spaced between said inlet and said outlet such that no more than 82 volume percent of the solid alkylation catalyst is located between any two adjacent injection points or located between the inlet or the outlet, and the injection point which is nearest, and thereby produces a product stream which is depleted in benzene content and toluene content and enhanced in alkylbenzene content as compared to said light gasoline stream; the process being further characterized in that the alkylating agent is injected simultaneously into the alkylation zone at multiple injection points such that each of the injection points injects no more than 75 mole percent of the total amount in moles of the alkylating agent and such that the total amount of the alkylating agent employed in the process is from about 2.0 to about 3.0 times the amount of benzene and toluene in moles in said light gasoline stream.

9. The process of claim 7 further characterized in that the product stream has an atmospheric boiling endpoint of 230° C. or less as determined by American Society for Testing Materials method D86.

10. A process for reducing the benzene content in gasoline which comprises the steps of:

(a.) mixing a light gasoline stream comprising benzene and toluene but comprising substantially no other aromatic hydrocarbons with a first alkylating stream, which comprises an alkylating agent, in a proportion of from about 0.7 to about 1.7 moles of the alkylating agent per mole of benzene in the light gasoline stream in order to produce a first process stream;

(b.) passing the first process stream to a first alkylation zone which contains a first bed of solid alkylation catalyst maintained at mixed phase alkylation conditions and converting the first process stream to a first effluent stream which comprises less benzene and more alkylbenzene as compared to the light reformate stream;

(c.) mixing the first effluent stream with a second alkylating stream, which comprises the alkylating agent, in a proportion of from about 0.7 to about 1.7 moles of the alkylating agent per mole of benzene in the light gasoline stream in order to produce a second process stream;

(d.) passing the second process stream to a second alkylation zone which contains a second bed of solid alkylation catalyst maintained at mixed phase alkylation conditions and converting the second process stream to a second effluent stream which comprises less benzene and more alkylbenzene as compared to the first effluent stream;

(e.) mixing the second effluent stream with a third alkylating stream, which comprises the alkylating agent, in a proportion of from about 0.7 to about 1.7 moles of the alkylating agent per mole of benzene in the light gasoline stream in order to produce a third process stream; and (f.) passing the third process stream to a third alkylation zone which contains a third bed of solid alkylation catalyst maintained at alkylation conditions and converting the third process stream to a third effluent stream which comprises less benzene and more alkylbenzene as compared to the second effluent stream and which contains an amount of benzene that is less than 30% of the amount of benzene in the light gasoline stream.

* * * * *